US008870420B2

(12) United States Patent
Kurkofka et al.

(10) Patent No.: US 8,870,420 B2
(45) Date of Patent: Oct. 28, 2014

(54) STREET LAMP

(71) Applicants: Waldemar Kurkofka, Rheda-Wiedenbruck (DE); Hendrik Kleinemeier, Rietberg (DE); Alexander Kerpe, Lippstadt (DE)

(72) Inventors: Waldemar Kurkofka, Rheda-Wiedenbruck (DE); Hendrik Kleinemeier, Rietberg (DE); Alexander Kerpe, Lippstadt (DE)

(73) Assignee: Hella KGAA Hueck & Co., Lippstadt (DE)

( * ) Notice: Subject to any disclaimer, the term of this patent is extended or adjusted under 35 U.S.C. 154(b) by 0 days.

(21) Appl. No.: 13/633,634

(22) Filed: Oct. 2, 2012

(65) Prior Publication Data

US 2013/0100673 A1 Apr. 25, 2013

Related U.S. Application Data

(63) Continuation of application No. PCT/EP2011/054916, filed on Mar. 30, 2011.

(30) Foreign Application Priority Data

Apr. 3, 2010 (DE) ..... 10 2010 013 801

(51) Int. Cl.

| | |
|---|---|
| ***F21S 8/00*** | (2006.01) |
| ***F21S 13/10*** | (2006.01) |
| ***F21V 31/00*** | (2006.01) |
| ***F21S 8/08*** | (2006.01) |
| ***F21V 23/02*** | (2006.01) |
| *F21W 131/103* | (2006.01) |

(52) U.S. Cl.

CPC ..... *F21V 31/00* (2013.01); *F21W 2131/103* (2013.01); *F21S 8/086* (2013.01); *F21V 23/02* (2013.01); *Y10S 362/80* (2013.01)

USPC ..... 362/431; 362/800

(58) Field of Classification Search

CPC ..... F21S 8/00; F21S 8/08; F21S 8/085; F21S 8/086; F21S 8/088; F21V 23/02; F21V 23/023; F21V 23/026; F21V 31/00; F21W 2131/103

USPC ..... 362/431, 800

See application file for complete search history.

(56) References Cited

U.S. PATENT DOCUMENTS

| | | | | |
|---|---|---|---|---|
| 2008/0298051 | A1 | 12/2008 | Chu | |
| 2009/0046449 | A1* | 2/2009 | Li | 362/153.1 |
| 2009/0046460 | A1 | 2/2009 | Li | |
| 2009/0086472 | A1 | 4/2009 | Kinnune | |
| 2009/0185374 | A1 | 7/2009 | Wu et al. | |

FOREIGN PATENT DOCUMENTS

| | | | |
|---|---|---|---|
| DE | 20114085 | U1 | 8/2001 |
| DE | 20214424 | U1 | 9/2002 |
| DE | 202006000973 | U1 | 6/2006 |

(Continued)

OTHER PUBLICATIONS

The International Search Report as mailed on Jun. 27, 2011 for International Application No. PCT/EP2011/054916.

*Primary Examiner* — Jason Moon Han

(74) *Attorney, Agent, or Firm* — Yakov Sidorin; Quarles & Brady LLP

(57) ABSTRACT

The invention relates to a street lamp. In order to reduce the sealing expenditure, it is proposed to arrange the ballast device in the lamp head. A lead is here designed in one piece from a terminal box to the holders.

3 Claims, 3 Drawing Sheets

(56) References Cited

FOREIGN PATENT DOCUMENTS

| | | | |
|---|---|---|---|
| DE | 102005048497 | A1 | 4/2007 |
| EP | 1906081 | | 4/2008 |
| EP | 19651301 | A | 9/2008 |
| EP | 19651301 | A1 | 9/2008 |
| WO | 2005073629 | | 8/2005 |
| WO | 2008059547 | A1 | 5/2008 |
| WO | 2010119146 | A1 | 10/2010 |

* cited by examiner

STREET LAMP

CROSS-REFERENCES TO RELATED APPLICATIONS

The present application is a continuation of International Application No. PCT/EP2011/054916 filed on Mar. 30, 2011 which claims the benefit of German Patent Application No. 10 2010 013 801.0 filed on Apr. 3, 2010. Each of the above-referenced patent applications are incorporated herein by reference in their entirety.

The invention relates to a street lamp comprising a pole in the base region whereof a junction box is arranged, comprising a lamp head in which at least one illuminant is arranged, comprising at least one ballast device and comprising an electrical lead which is guided in one piece from the junction box to the lamp head.

Such street lamps are known per se and are used for lighting of, for example, roads and pathways. The lamp head is either fastened directly or by means of a side arm at the upper end of the pole.

Known from US 2009/0046449 A1 is a street lamp in which a lamp head with LED lights is arranged on a side arm of a pole. An electrical lead of the street lamp is connected electrically in a junction box to a power supply network. The lead is guided in the lamp head. A ballast device is arranged in the junction box. This has the disadvantage that the ballast device and its terminals must be sealed against wetness and moisture.

It is therefore the object of the invention to provide a street lamp in which a sealing expenditure is reduced.

The object is solved by the features of claim 1. The ballast device is arranged in the lamp head. As a result, said ballast device can be integrated in the street lamp in a watertight manner without additional expenditure and protected from moisture.

The subclaims relate to the advantageous embodiment of the invention.

In one alternative the illuminant is at least one LED array. This has a low energy requirement with a high light yield. Further components, e.g. for energy management can be simply arranged on a printed circuit board of the LED array.

In a preferred alternative the LED array is combined with the ballast device to form a watertight module. As a result, the entire electrics/electronics are securely encapsulated. During maintenance and in the case of a fault, only a few parts need to be examined and optionally repaired or exchanged. Overall the assembly expenditure of the street lamp is reduced.

In a further alternative, the module is contacted by means of a plug as holder in a watertight manner with the lead. This facilitates assembly and maintenance work. The module can be safely exchanged when voltage is applied so that immediate monitoring is possible.

The invention is explained in detail hereinafter with reference to the appended drawings. In the figures.

Figure 1:
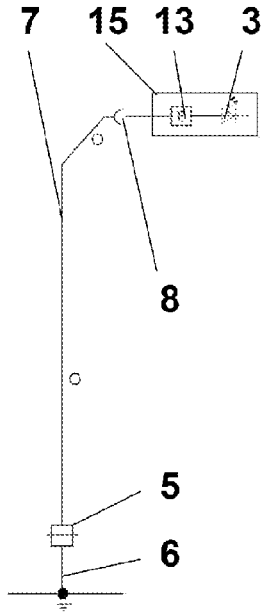
FIG. 1 shows an electrical diagram of a street lamp.
Figure 2:
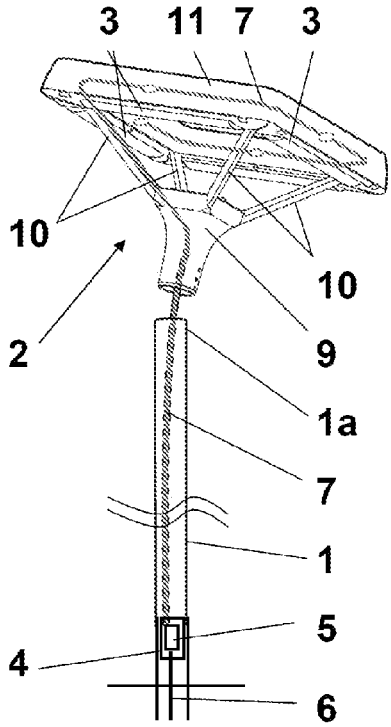
FIG. 2 shows a schematic diagram of the street lamp.
Figure 3:
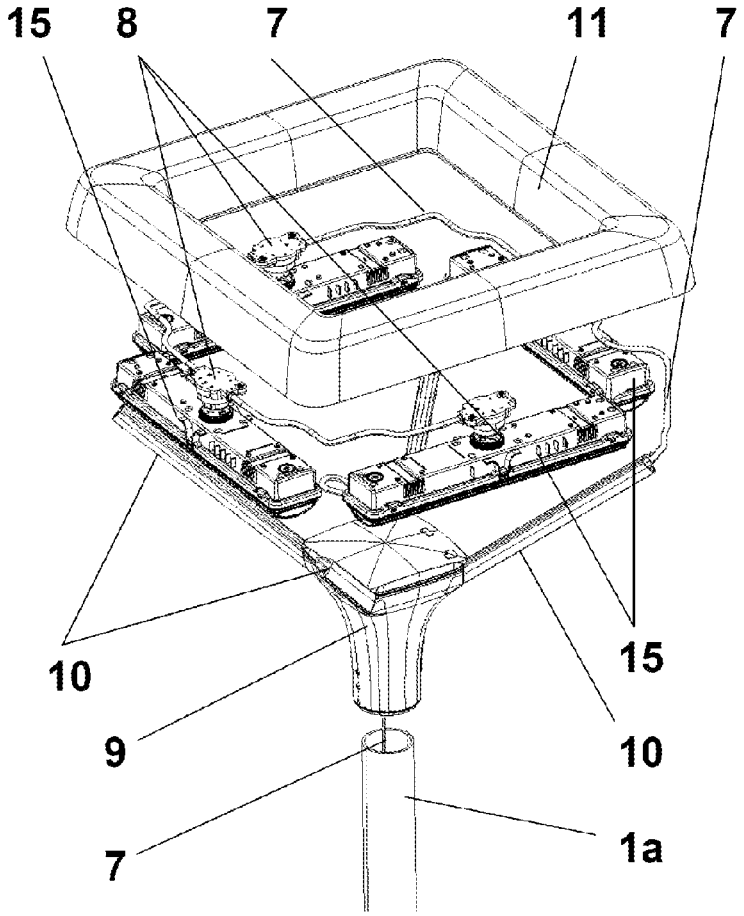
FIG. 3 shows an exploded view of a pole top with a lamp head.
Figure 4:
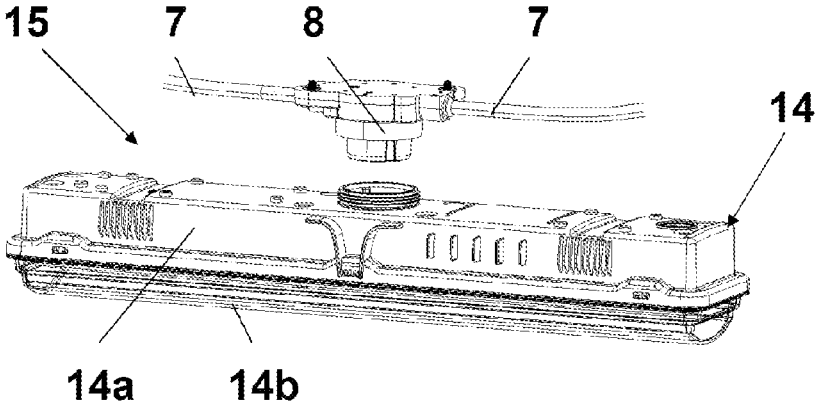
FIG. 4 shows a view of the illuminant module and a cable section with plug as detail and FIG. 5 shows a section through the module.
Figure 5:
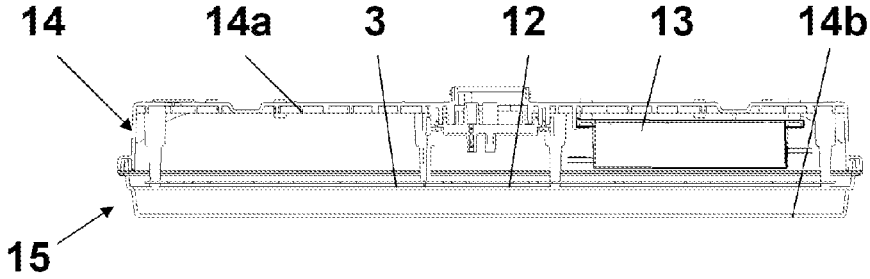

As can be seen from the figures, a first end of the pole 1 of a street lamp is, for example, anchored in the ground. A lamp head 2 is fastened to an upper second end of the pole 1, a pole top 1*a*. Illuminants 3 are arranged in the lamp head 2 so that during operation they emit light downwards in the direction of the bottom with a defined light distribution.

In its lower region the pole 1 has a junction box 4 at a height of about 0.5 m to 1.0 m above the ground. The junction box 4 comprises a terminal box 5 which is fastened in the pole 1 and at which a cable connection 6 can be connected to an electrical power supply network. An electrical lead 7 (cable) is connected to the terminal box 5, which lead is guided in one piece in the pole 1 and further to holders for the illuminants 3. The junction box 4 can be closed by means of a door not shown. For connection of the illuminants 3 to the lead 7, the holders in the form of plugs 8 are contacted in parallel according to the number of illuminants 3 and fastened in a watertight manner. The lead 7 is looped through into the plugs 8.

The lamp head 2 comprises a base 9 which is fastened by its lower end to the pole top 1*a*. At an upper end of the base 9, four tubular struts 10 are fastened with equal spacing, which struts point obliquely radially outwards and upwards in a radial manner. An annular hood 11 is fastened at upper ends of the struts 10. The hood 11 is fundamentally rectangular with rounded corners and an approximately U-shaped cross-section which is open towards the bottom. The lead 7 is guided through the base 9 and one of the struts 10 into the hood 11.

The four illuminants 3 here are fastened detachably inside the cross-section of the hood 11. Each of the illuminants 3 comprises an LED array 12 having a plurality of LEDs which are arranged on a printed circuit board together with other electrical and/or electronic components. Each illuminant 3 is assigned a ballast device 13. The illuminant 3 and the ballast device 13 are combined in a housing 14 to form a module 15. The housing 14 comprises a box-shaped receptacle 14*a* in which a socket for one of the plugs 8 is integrated and a cover 14*b* made of transparent clear material. The LEDs are directed towards the cover 14*b*. The receptacle 14*a* and the cover 14*b* are glued tightly to one another.

Alternatively to the LED array 12, other illuminants such as, for example, incandescent lamps or fluorescent lamps can be used.

REFERENCE LIST

1 Pole
1*a* Pole top
2 Lamp head
3 Illuminant
4 Junction box
5 Terminal box
6 Cable connection
7 Lead
8 Plug
9 Base
10 Strut
11 Hood
12 LED array
13 Ballast device
14 Housing
14*a* Receptacle
14*b* Cover
15 Module

What is claimed is:

1. A street lamp comprising:

a pole with a base region;

a junction box in the base region;

a lamp head in which at least one illuminant is arranged;

at least one ballast device in the lamp head; and an electrical lead, which is guided in one piece from the junction box to the lamp head, and a holder structured as a plug providing electrical connection between the at least one Illuminant and the electrical lead in a water-tight manner, wherein said electrical lead is looped through said plug for connecting to another plug.

2. The street lamp according to claim 1, characterized in that the illuminant includes at least one LED array.

3. The street lamp according to claim 2, characterized in that the at least one LED array is combined with the ballast device to form a water-tight module.

* * * * *